US010731873B2

(12) United States Patent
Adachi et al.

(10) Patent No.: US 10,731,873 B2
(45) Date of Patent: Aug. 4, 2020

(54) INDOOR UNIT FOR AIR-CONDITIONING APPARATUS

(71) Applicant: Mitsubishi Electric Corporation, Tokyo (JP)

(72) Inventors: Yusuke Adachi, Tokyo (JP); Syogo Namatame, Tokyo (JP); Shuhei Yokota, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/099,729

(22) PCT Filed: Apr. 3, 2017

(86) PCT No.: PCT/JP2017/013886
§ 371 (c)(1),
(2) Date: Nov. 8, 2018

(87) PCT Pub. No.: WO2018/029900
PCT Pub. Date: Feb. 15, 2018

(65) Prior Publication Data

US 2019/0154276 A1 May 23, 2019

(30) Foreign Application Priority Data

Aug. 10, 2016 (WO) ..... PCT/JP2016/073631

(51) Int. Cl.
*F24F 13/14* (2006.01)
*F24F 1/0011* (2019.01)
(Continued)

(52) U.S. Cl.
CPC ..... *F24F 1/0011* (2013.01); *F24F 1/0018* (2013.01); *F24F 13/16* (2013.01)

(58) Field of Classification Search
CPC ..... F24F 1/0011; F24F 1/0018; F24F 13/16; F24F 1/0014; F24F 1/0057; F24F 1/0059;
(Continued)

(56) References Cited

U.S. PATENT DOCUMENTS 4,913,622 A 4/1990 Tanaka et al.
5,197,850 A 3/1993 Shinobu et al.
(Continued)

FOREIGN PATENT DOCUMENTS

EP 2 918 929 A1 9/2015
JP S63-220035 A 9/1988
(Continued)

OTHER PUBLICATIONS

Extended European Search Report dated Nov. 6, 2018 issued in corresponding EP patent application No. 17838976.3.
(Continued)

*Primary Examiner* — Emmanuel E Duke
(74) *Attorney, Agent, or Firm* — Posz Law Group, PLC

(57) ABSTRACT

An indoor unit for an air-conditioning apparatus includes a casing, an up-down airflow direction plate rotatably supported in the air outlet, and an auxiliary airflow direction plate rotatably supported below, and on an upstream side of, the up-down airflow direction plate. The up-down airflow direction plate has a main blade part formed of a flat plate and a rear edge part formed of a flat plate. When the main blade part is in a horizontal state, the rear edge part is inclined upward to a back face of the casing from the main blade part. When an angle α formed between the main blade part and the rear edge part and an angle ε formed between the main blade part and a virtual line through a center of a tip part of the auxiliary airflow direction plate, ε is greater than α.

5 Claims, 6 Drawing Sheets

(51) Int. Cl.
*F24F 13/16* (2006.01)
*F24F 1/0018* (2019.01)

(58) Field of Classification Search
CPC ..... F24F 1/0003; F24F 1/0029; F24F 1/0025; F24F 1/0007; F24F 13/22; F24F 13/14; F24F 13/10; F24F 13/15; F24F 13/20; F24F 13/08; F24F 13/06; F24F 13/24; F24F 11/54; F24F 11/79; F24F 11/89; F24F 11/76; F24F 11/30; F24F 11/0078; F24F 11/65; F24F 11/72; F24F 7/007; F24F 7/065; F04D 17/04; F04D 29/563; F04D 29/281
See application file for complete search history.

(56) References Cited

U.S. PATENT DOCUMENTS 5,924,923 A * 7/1999 Chiguchi ..... F24F 1/0011 454/256
2002/0016149 A1* 2/2002 Kondou ..... F24F 1/0007 454/315
2014/0227961 A1* 8/2014 Yasutomi ..... F24F 1/0011 454/325
2015/0087219 A1* 3/2015 Yasutomi ..... F24F 1/0057 454/256
2015/0153063 A1* 6/2015 Yasutomi ..... F24F 1/0011 454/241
2015/0176850 A1* 6/2015 Nakai ..... F24F 13/1426 454/329
2017/0370612 A1* 12/2017 Kuramori ..... F24F 13/22

FOREIGN PATENT DOCUMENTS

JP H10-009657 A 1/1998
JP H11-037537 A 2/1999
JP 2005-188847 A 7/2005
JP 2008-101868 A 5/2008
JP 2012-117805 A 6/2012
JP 2014-055732 A 3/2014
JP 2014-134381 A 7/2014
JP 2015-031454 A 2/2015
WO 2012/073511 A1 6/2012

OTHER PUBLICATIONS

Office Action dated Nov. 12, 2019 issued in corresponding JP patent application No. 2018-533416 (and English translation).
International Search Report ("ISR") dated Jun. 20, 2017 issued in corresponding international patent application No. PCT/JP2017/013886.
Office Action dated May 7, 2020 issued in corresponding CN patent application No. 201780048291.3 (and English translation).

* cited by examiner

<UP-DOWN AIRFLOW DIRECTION PLATE 27>

<UP-DOWN AIRFLOW DIRECTION PLATE 27X>

INDOOR UNIT FOR AIR-CONDITIONING APPARATUS

CROSS REFERENCE TO RELATED APPLICATION

This application is a U.S. national stage application of International Application No. PCT/JP2017/013886 filed on Apr. 3, 2017, which claims priority to the International Application No. PCT/JP2016/073631 filed on Aug. 10, 2016, the contents of which are incorporated herein by reference.

TECHNICAL FIELD

The present invention relates to an indoor unit for an air-conditioning apparatus, the indoor unit having an up-down airflow direction plate in an air outlet.

BACKGROUND ART

Typical indoor units for air-conditioning apparatuses are each provided with an up-down airflow direction plate in an air outlet to adjust the flow of air blown off from the air outlet. As one of such indoor units for air-conditioning apparatuses, an indoor unit that includes a fan arranged in an airflow passage extending from an air inlet to an air outlet, a heat exchanger arranged around the fan, and an up-down airflow direction plate and an auxiliary airflow direction plate extending along the longitudinal direction of the air outlet, the up-down airflow direction plate being formed as one flat plate, is disclosed (see Patent Literature 1, for example).

CITATION LIST

Patent Literature

Patent Literature 1: Japanese Unexamined Patent Application Publication No. 2014-134381

SUMMARY OF INVENTION

Technical Problem

In the conventional indoor unit for an air-conditioning apparatus described in Patent Literature 1, in a cooling operation, the up-down airflow direction plate is set to an angle close to horizontal so that cold air that is blown off from the air outlet flows in a horizontal direction. However, because the up-down airflow direction plate is formed of one flat plate, the flow of the cold air cooled by the heat exchanger separates from the underside surface of the up-down airflow direction plate, and as a result, a surrounding air having a higher temperature and a higher humidity than the cold air is brought into contact with the underside surface of the up-down airflow direction plate. Because the cold air stays in contact with the upside surface of the up-down airflow direction plate, thereby cooling the up-down airflow direction plate, dew condensation occurs on the underside surface of the up-down airflow direction plate when the temperature of the up-down airflow direction plate is reduced to the dew point of the surrounding air or below. When more dew drops are formed, the dew drops may eventually fall from the up-down airflow direction plate.

Furthermore, because the up-down airflow direction plate is configured to be flat, the up-down airflow direction plate may have a low stiffness and becomes easily deformed, thereby having an unintended size or angle. Consequently, during a cooling operation, not only the formation of dew on the up-down airflow direction plate due to the separation of the flow of the cold air from the up-down airflow direction plate, but also an increase in pressure loss of the air blown off from the air outlet may cause deterioration of the performance. In addition, even when the indoor unit is not operated, such deformation forms a gap between the up-down airflow direction plate and the front panel, and as a result, dirt may enter the inside of the air outlet, and the up-down airflow direction plate and the inside of the air outlet may be fouled or damaged.

To solve the abovementioned problems, the present invention provides an indoor unit for an air-conditioning apparatus in which dew concentration on the up-down airflow direction plate and deformation of the up-down airflow direction plate in the longitudinal direction are prevented from occurring.

Solution to Problem

An indoor unit for an air-conditioning apparatus according to one embodiment of the present invention includes a casing having an air inlet and an air outlet, an up-down airflow direction plate configured to be rotatably supported in the air outlet, and an auxiliary airflow direction plate configured to be rotatably supported at a position below the up-down airflow direction plate and on an upstream side of the up-down airflow direction plate. The up-down airflow direction plate has a main blade part formed of a flat plate and a rear edge part formed of a flat plate and formed on an upstream side of the main blade part. When the main blade part is in a horizontal state, the rear edge part is inclined upward to a back face of the casing from the main blade part. When an angle $\alpha$ represents an angle formed between the main blade part and the rear edge part and an angle $\varepsilon$ represents an angle formed between the main blade part and a virtual line passing through a center of a tip part of the auxiliary airflow direction plate, the angle $\varepsilon$ is greater than the angle $\alpha$.

Advantageous Effects of Invention

In the indoor unit for an air-conditioning apparatus of one embodiment of the present invention, because the indoor unit includes the up-down airflow direction plate and the auxiliary airflow direction plate and the positional relationship between the up-down airflow direction plate and the auxiliary airflow direction plate for operation is specified, the cold air flows along the up-down airflow direction plate without separating from the underside surface of the up-down airflow direction plate during a cooling operation, and as a result, a surrounding air having a higher temperature and a higher humidity than the cold air is not brought into contact with the up-down airflow direction plate and dew concentration is prevented from occurring on the up-down airflow direction plate. In addition, because the up-down airflow direction plate is made up of the main blade part and the rear edge part, the stiffness of the up-down airflow direction plate is increased and deformation of the up-down airflow direction plate is prevented from occurring.

DESCRIPTION OF EMBODIMENTS

Figure 1:
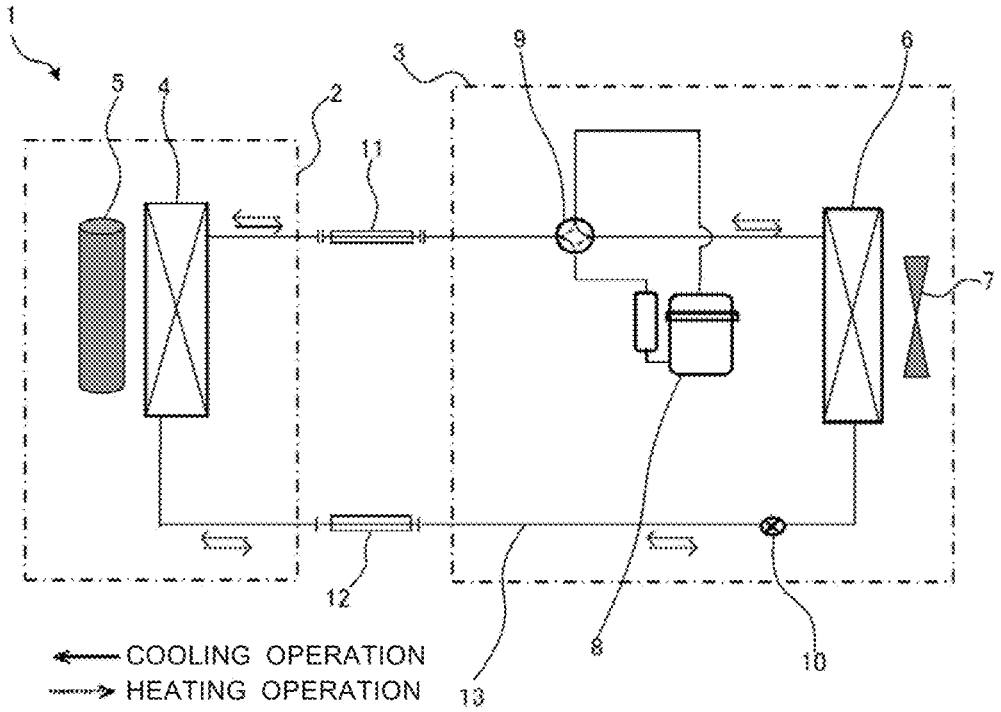
FIG. 1 is a schematic block diagram illustrating one example of a refrigerant circuit configuration of an air-conditioning apparatus having an indoor unit of Embodiment 1 of the present invention.

Embodiments of the present invention will be described below with reference to the drawings. Note that, in the drawings including FIG. 1, the dimensional relationships among the components may differ from the actual relationships. Also note that, in the drawings including FIG. 1, elements denoted by the same reference signs are the same or corresponding elements throughout the specification. Furthermore, note that configurations of the elements represented in the specification are merely examples and are not limited to the examples.

Embodiment 1

FIG. 1 is a schematic block diagram illustrating one example of a refrigerant circuit configuration of an air-conditioning apparatus 1 having an indoor unit 2 of Embodiment 1 of the present invention. Note that, in FIG. 1, solid arrows represent the flows of refrigerant in a cooling operation, and dashed arrows represent the flows of the refrigerant in a heating operation.

<Configuration of Air-Conditioning Apparatus 1>

As shown in FIG. 1, the air-conditioning apparatus 1 includes an indoor unit 2 and an outdoor unit 3.

The indoor unit 2 includes an indoor heat exchanger 4 and an indoor fan 5.

The outdoor unit 3 includes an outdoor heat exchanger 6, an outdoor fan 7, a compressor 8, a four-way switching valve 9, and an expansion valve 10.

The indoor unit 2 and the outdoor unit 3 are connected to each other by a gas-side communication pipe 11 and a liquid-side communication pipe 12 to form a refrigerant circuit 13.

The air-conditioning apparatus 1 can switch between a cooling operation and a heating operation by switching paths of the four-way switching valve 9. With the path of the four-way switching valve 9 indicated by a solid line in FIG. 1, the air-conditioning apparatus 1 performs a cooling operation. Meanwhile, with the path of the four-way switching valve 9 indicated by a dashed line in FIG. 1, the air-conditioning apparatus 1 performs a heating operation.

(Indoor Unit 2)

The indoor unit 2 is installed in a space (e.g., indoor space) that is an air-conditioned space to which cooling energy or heating energy is supplied, and has a function of cooling or heating the air-conditioned space by using the cooling energy or heating energy supplied from the outdoor unit 3.

The indoor heat exchanger 4 acts as a condenser in a heating operation and as an evaporator in a cooling operation. The indoor heat exchanger 4 can be formed of a fin-and-tube type heat exchanger, for example.

The indoor fan 5 is arranged to be surrounded by the indoor heat exchanger 4, and supplies air that is a heat exchange fluid to the indoor heat exchanger 4.

(Outdoor Unit 3)

The outdoor unit 3 is installed in a space (e.g., outdoor space) different from the air-conditioned space, and has a function of suppling cooling energy or heating energy to the indoor unit 2.

The outdoor heat exchanger 6 acts as an evaporator in a heating operation and as a condenser in a cooling operation.

The outdoor fan 7 supplies air that is a heat exchange fluid to the outdoor heat exchanger 6. The outdoor fan 7 can be formed of a propeller fan having a plurality of blades.

The compressor 8 compresses and discharges refrigerant. The compressor 8 can be formed of, for example, a rotary compressor, a scroll compressor, a screw compressor, a reciprocating compressor, or other types of compressor. When the outdoor heat exchanger 6 acts as a condenser, the refrigerant discharged from the compressor 8 is sent through a refrigerant pipe to the outdoor heat exchanger 6. When the outdoor heat exchanger 6 acts as an evaporator, the refrigerant discharged from the compressor 8 is sent through refrigerant pipes to the outdoor heat exchanger 6 via the indoor unit 2.

The four-way switching valve 9 is installed on the discharge side of the compressor 8, and switches the flow of refrigerant between a heating operation and a cooling operation.

The expansion valve 10 expands the refrigerant that has passed through the indoor heat exchanger 4 or the outdoor heat exchanger 6, to reduce the pressure of the refrigerant. The expansion valve 10 can be formed of, for example, an electric expansion valve capable of controlling the flow rate of refrigerant. Note that the expansion valve 10 may be arranged in the indoor unit 2, instead of in the outdoor unit 3.

In the air-conditioning apparatus 1, the compressor 8, the indoor heat exchanger 4, the expansion valve 10, and the outdoor heat exchanger 6 are connected by refrigerant pipes, including the gas-side communication pipe 11 and the liquid-side communication pipe 12, to form the refrigerant circuit 13.

<Operations of Air-Conditioning Apparatus 1>

Next, operations of the air-conditioning apparatus 1 will be explained with flows of refrigerant. First, a cooling operation that the air-conditioning apparatus 1 performs will be explained. Note that the flows of the refrigerant in a cooling operation are indicated by solid arrows in FIG. 1. In the following example, operations of the air-conditioning apparatus 1 are explained with a case in which a heat exchange fluid is air and a heat-exchanged fluid is refrigerant.

When the compressor 8 is driven, refrigerant of a high-temperature high-pressure gas state is discharged from the compressor 8. Hereafter, the refrigerant flows in directions of the solid arrows. The high-temperature high-pressure gas refrigerant (single phase) discharged from the compressor 8 flows into the outdoor heat exchanger 6 that acts as a condenser via the four-way switching valve 9. In the outdoor heat exchanger 6, heat is exchanged between the high-temperature high-pressure gas refrigerant that flows into the outdoor heat exchanger 6 and air that is supplied by the outdoor fan 7, and then the high-temperature high-pressure gas refrigerant is condensed and becomes high-pressure liquid refrigerant (single phase).

At the expansion valve 10, the high-pressure liquid refrigerant discharged from the outdoor heat exchanger 6 becomes two-phase refrigerant containing low-pressure gas refrigerant and liquid refrigerant. The two-phase refrigerant flows into the indoor heat exchanger 4 that acts as an evaporator. In the indoor heat exchanger 4, heat is exchanged between the two-phase refrigerant that flows into the indoor heat exchanger 4 and air that is supplied by the indoor fan 5, and then the liquid refrigerant of the two-phase refrigerant is evaporated and becomes low-pressure gas refrigerant (single phase). The indoor space is cooled by this heat exchange. The low-pressure gas refrigerant discharged from the indoor heat exchanger 4 flows into the compressor 8 via the four-way switching valve 9, and is compressed to high-temperature high-pressure gas refrigerant, and then the high-temperature high-pressure gas refrigerant is discharged again from the compressor 8. Subsequently, this cycle is repeated.

Next, a heating operation that the air-conditioning apparatus 1 performs will be explained. Note that the flows of the refrigerant in a heating operation are indicated by dashed arrows in FIG. 1.

When the compressor 8 is driven, refrigerant of a high-temperature high-pressure gas state is discharged from the compressor 8. Hereafter, the refrigerant flows in directions of the dashed arrows. The high-temperature high-pressure gas refrigerant (single phase) discharged from the compressor 8 flows into the indoor heat exchanger 4 that acts as a condenser via the four-way switching valve 9. In the indoor heat exchanger 4, heat is exchanged between the high-temperature high-pressure gas refrigerant that flows into the indoor heat exchanger 4 and air that is supplied by the indoor fan 5, and then the high-temperature high-pressure gas refrigerant is condensed and becomes high-pressure liquid refrigerant (single phase). The indoor space is heated by this heat exchange.

At the expansion valve 10, the high-pressure liquid refrigerant discharged from the indoor heat exchanger 4 becomes two-phase refrigerant having low-pressure gas refrigerant and liquid refrigerant. The two-phase refrigerant flows into the outdoor heat exchanger 6 that acts as an evaporator. In the outdoor heat exchanger 6, heat is exchanged between the two-phase refrigerant that flows into the outdoor heat exchanger 6 and air that is supplied by the outdoor fan 7, and then the liquid refrigerant of the two-phase refrigerant is evaporated and becomes low-pressure gas refrigerant (single phase). The low-pressure gas refrigerant discharged from the outdoor heat exchanger 6 flows into the compressor 8 via the four-way switching valve 9, and is compressed to high-temperature high-pressure gas refrigerant, and then the high-temperature high-pressure gas refrigerant is discharged again from the compressor 8. Subsequently, this cycle is repeated.

<Details of Indoor Unit 2>

Next, details of the indoor unit 2 will be explained.

Figure 2:
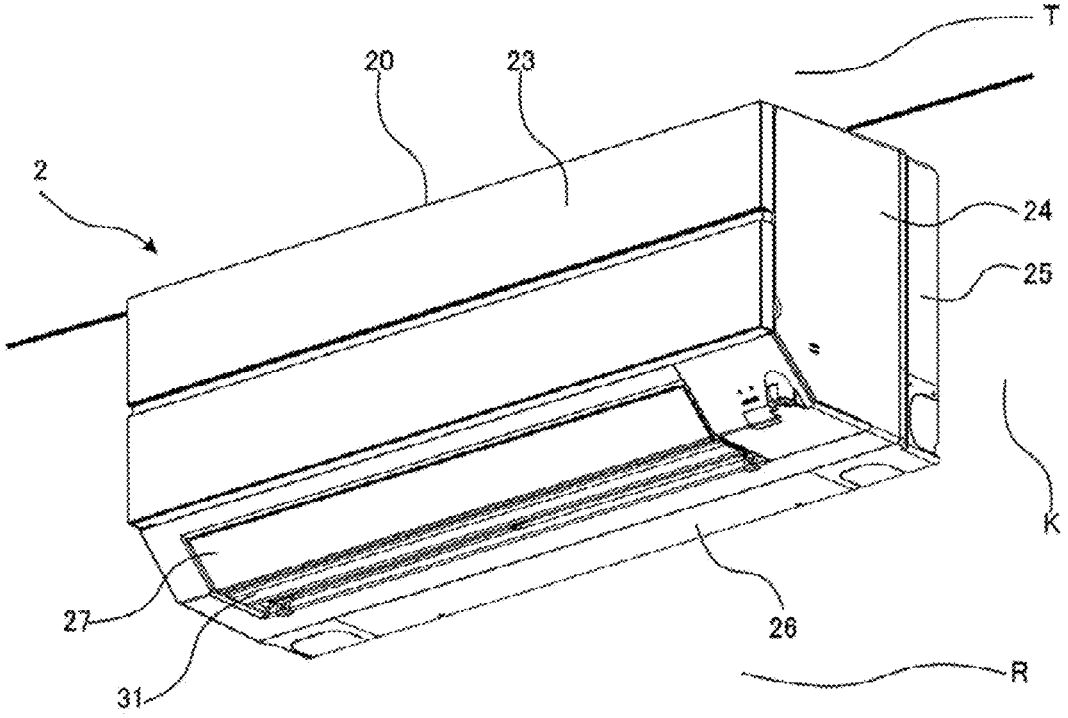
FIG. 2 is a schematic perspective view illustrating an installation example of the indoor unit of Embodiment 1 of the present invention.
Figure 3:
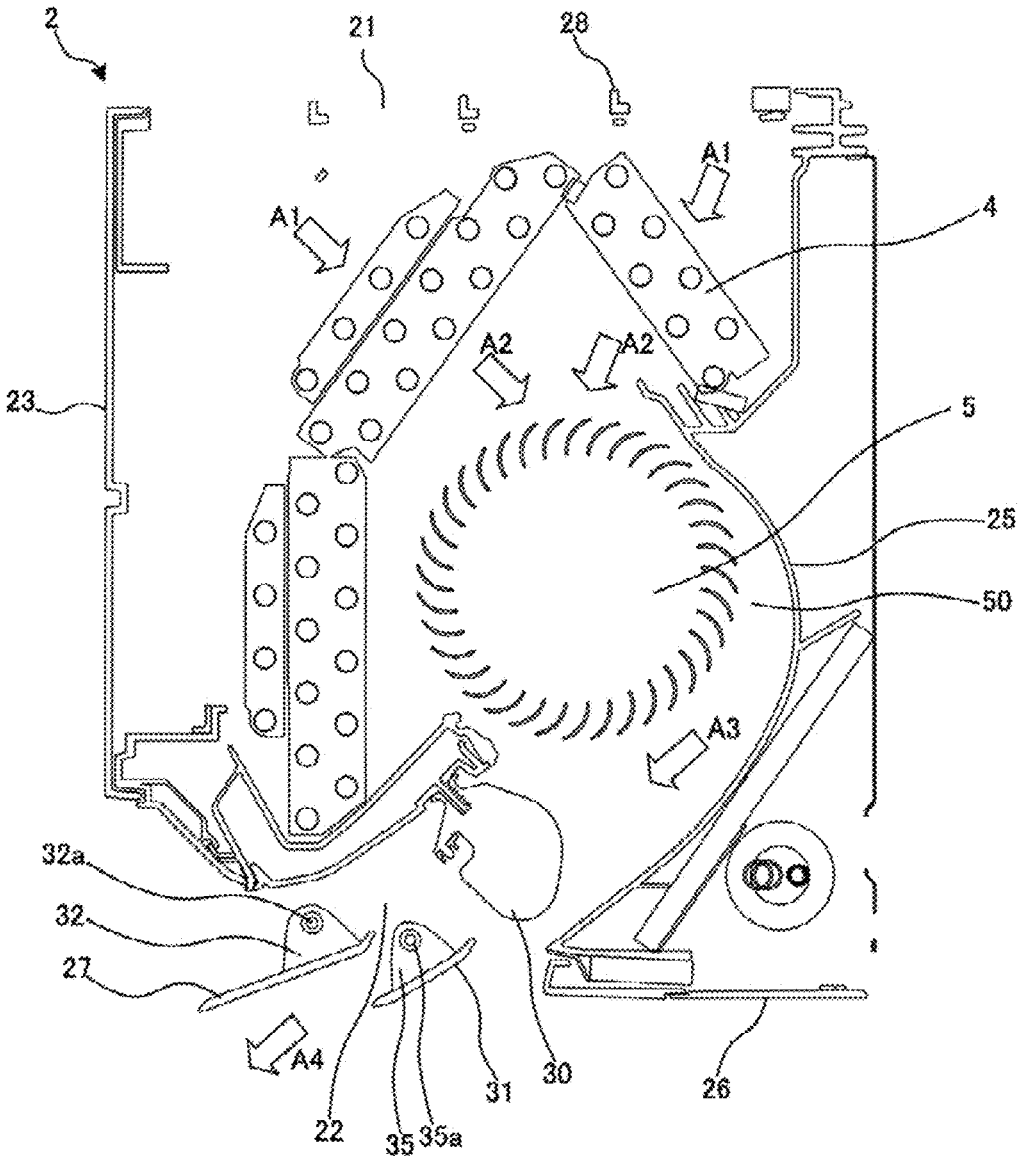
FIG. 3 is a longitudinal section viewed from a side illustrating an internal configuration of the indoor unit of Embodiment 1 of the present invention.

FIG. 2 is a schematic perspective view illustrating an installation example of the indoor unit 2. FIG. 3 is a longitudinal section viewed from a side illustrating an internal configuration of the indoor unit 2.

Note that, in the explanations, the indoor unit 2 has a back face facing a wall surface K, a front face opposite to the back face, a top face facing a ceiling T, a bottom face opposite to the top face, a right side face on the right side in FIG. 1, and a left side face opposite to the left side in FIG. 1. In addition, internal components of the indoor unit 2 will be explained with reference to a similar positional relationship.

In FIG. 3, arrows A1 to A4 represent flows of air.

As shown in FIG. 2, the indoor unit 2 is installed in a room R that is an air-conditioned space. The room R has a space surrounded by the ceiling T and wall surfaces K. The indoor unit 2 is configured to be installed so that the back face is fixed on a wall surface K and the top face is positioned close to the ceiling T.

As shown in FIG. 2, the indoor unit 2 has a casing 20 formed in a horizontally long rectangular parallelepiped shape. However, the shape of the casing 20 is not limited to a horizontally long rectangular parallelepiped shape. The casing 20 may be of any shape as long as the casing 20 has a box shape with at least one air inlet 21 for sucking air and at least one air outlet 22 for discharging air.

The casing 20 is covered by a front panel 23 constituting the front face, side panels 24 constituting the right and left faces, a back panel 25 constituting the back face, a bottom panel 26 constituting the bottom face, and a top panel 28 constituting the top face. Furthermore, the bottom of the casing 20 is covered by the back panel 25, the bottom panel 26, an up-down airflow direction plate 27, and an auxiliary airflow direction plate 31. The top of the casing 20 is covered by the top panel 28, and lattice-shaped openings are formed in the top panel 28.

The openings formed in the top panel 28 form the air inlet 21.

As shown in FIG. 3, a part of the casing 20 over which the up-down airflow direction plate 27 and the auxiliary airflow direction plate 31 cover has an opening to form the air outlet 22.

Inside the casing 20, an air passage 50 is formed through which the air inlet 21 and the air outlet 22 communicate with each other.

As shown in FIG. 3, the air outlet 22 is provided with a right-left airflow direction plate 30 for controlling the direction of airflow in a right-left direction, the up-down airflow direction plate 27 for controlling the direction of airflow in an up-down direction, and the auxiliary airflow direction plate 31. The right-left airflow direction plate 30 is arranged on the upstream side of the up-down airflow direction plate 27 and the auxiliary airflow direction plate 31 in the direction of airflow.

Furthermore, inside the casing 20, the indoor fan 5 that generates the airflow by diving a motor, which is not shown, is stored. Around the indoor fan 5, the indoor heat exchanger 4 is arranged. The indoor heat exchanger 4 exchanges heat between the refrigerant circulating in the refrigerant circuit 13 and the indoor air supplied by the indoor fan 5.

When the indoor fan 5 is driven, air is sucked from the air inlet 21 (arrows A1). Then, when passing through the indoor heat exchanger 4, the air sucked from the air inlet 21 exchanges heat with the refrigerant flowing inside the indoor heat exchanger 4 (arrows A2). In the heat exchange, the air is cooled in a cooling operation or is heated in a heating operation, and then the air reaches the indoor fan 5. The air (arrow A3) that has passed through the inside of the indoor fan 5 or a gap between the indoor fan 5 and the back panel 25 is blown off forward or downward from the air outlet 22 (arrow A4).

The up-down airflow direction plate 27 extends along the longitudinal direction (right-left direction) of the air outlet 22, changes, in an up-down direction, the flow direction of the air blown off from the air outlet 22, and opens and closes the air outlet 22. In the longitudinal direction (right-left direction of the air outlet 22), the up-down airflow direction plate 27 is provided with several (at least two) supporters 32 for rotatably supporting the up-down airflow direction plate 27. A rotation shaft 32*a* is connected to the supporters 32. That is, when the rotation shaft 32*a* rotates, the up-down airflow direction plate 27 rotates with the rotation shaft 32*a* as the supporters 32 rotatably supporting the up-down airflow direction plate 27 and is connected to the rotation shaft 32*a*.

The auxiliary airflow direction plate 31 extends along the longitudinal direction (right-left direction) of the air outlet 22, changes, in an up-down direction, the flow direction of the air blown off from the air outlet 22, and opens and closes the air outlet 22. The auxiliary airflow direction plate 31 is arranged closer to the back face than is the up-down airflow direction plate 27. In the longitudinal direction (right-left direction of the air outlet 22), the auxiliary airflow direction plate 31 is provided with several (at least two) auxiliary supporters 35 for rotatably supporting the auxiliary airflow direction plate 31. An auxiliary rotation shaft 35*a* is connected to the auxiliary supporters 35. That is, when the auxiliary rotation shaft 35*a* rotates, the auxiliary airflow direction plate 31 rotates with the auxiliary rotation shaft 35*a* as the auxiliary supporters 35 rotatably supporting the auxiliary airflow direction plate 31 and is connected to the auxiliary rotation shaft 35*a*.

<Details of Up-Down Airflow Direction Plate 27 and Auxiliary Airflow Direction Plate 31>

Figure 4:
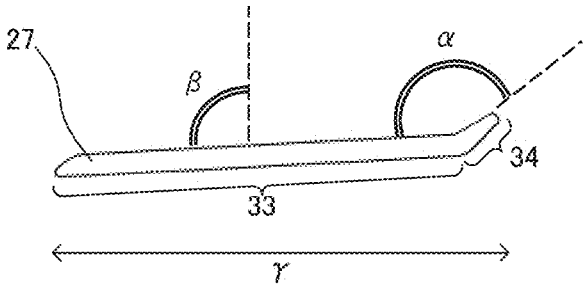
FIG. 4 is a longitudinal section of an up-down airflow direction plate provided in the indoor unit of Embodiment 1 of the present invention illustrating an enlarged view from a side.

FIG. 4 is a longitudinal section of the up-down airflow direction plate 27 provided in the indoor unit 2 illustrating an enlarged view from a side.

As shown in FIG. 4, the up-down airflow direction plate 27 is made up of a main blade part 33 that is formed as a flat plate, and a rear edge part 34 that is formed as a flat plate. The up-down airflow direction plate 27 is formed by joining the main blade part 33 and the rear edge part 34 to form a V-shape (L-shape) bend having a certain angle α between the main blade part 33 and the rear edge part 34. That is, when the main blade part 33 is in a horizontal state, the rear edge part 34 is inclined upward to the back face from the main blade part 33. In addition, a tilt of the main blade part 33 to the vertical is illustrated as a tilt R. Note that a lateral direction of the up-down airflow direction plate 27 is represented by an arrow y. The main blade part 33 has the largest exposed area in the up-down airflow direction plate 27 and is formed as a flat plate having a largest length. Furthermore, in the up-down airflow direction plate 27, elements other than the main blade part 33 and the rear edge part 34 may be combined.

The up-down airflow direction plate 27 and the auxiliary airflow direction plate 31 rotate as a drive motor, which is not shown, is driven to turn the rotation shaft 32*a* and the auxiliary rotation shaft 35*a*. The up-down airflow direction plate 27 and the auxiliary airflow direction plate 31 can rotate in a range from an upper structure abutment position (a fully closed state) to a lower structure abutment position (a fully open state).

Figure 5:
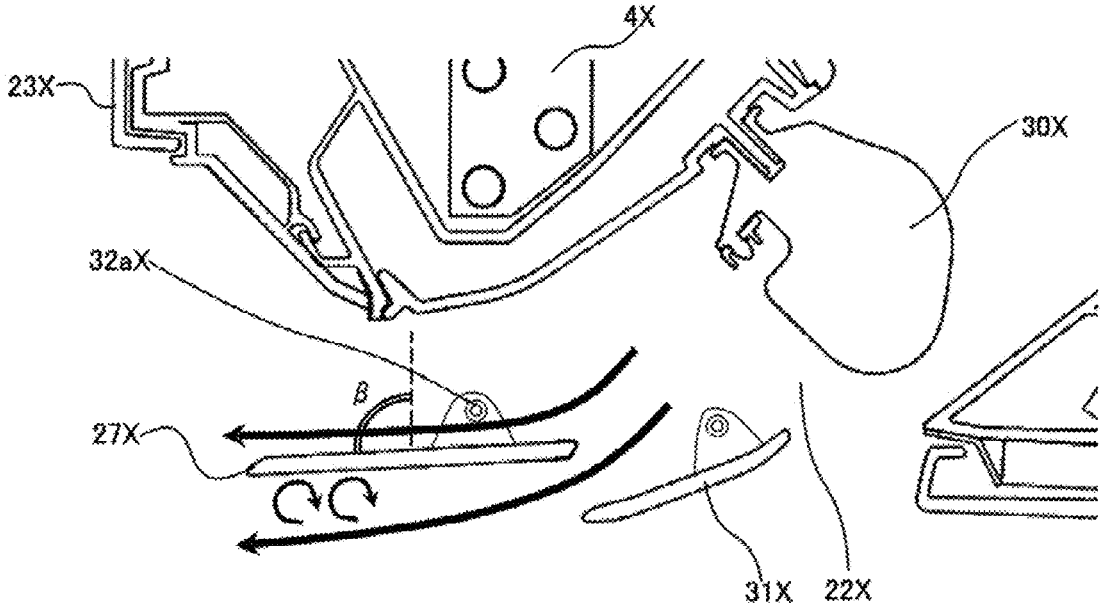
FIG. 5 is a schematic longitudinal section viewed from a side illustrating a vicinity of an air outlet of a conventional indoor unit.
Figure 6:
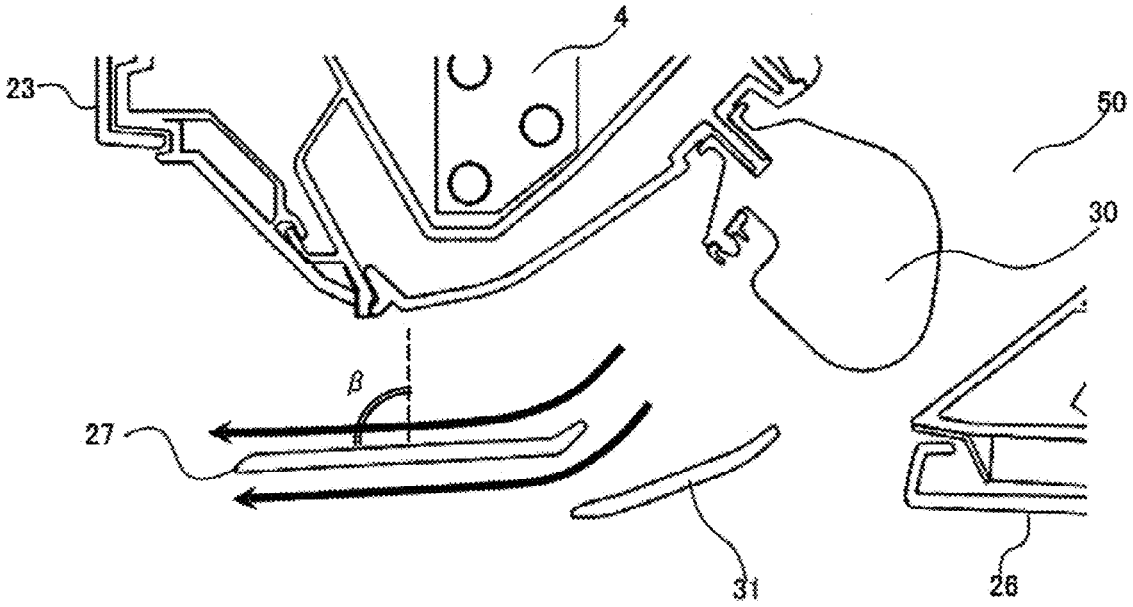
FIG. 6 is a schematic longitudinal section viewed from a side illustrating a vicinity of an air outlet of the indoor unit of Embodiment 1 of the present invention.
Figure 7:
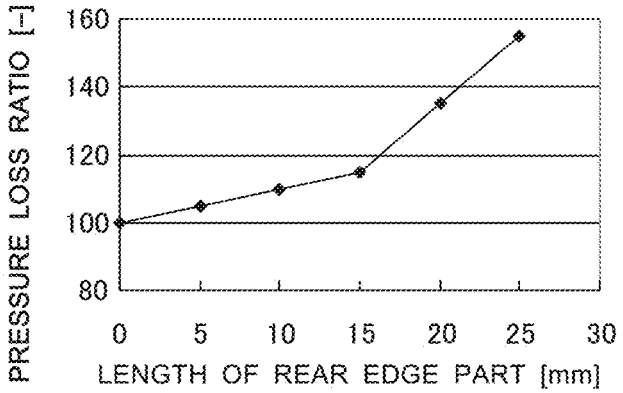
FIG. 7 is a graph showing the relationship of a pressure loss ratio to the length of a rear edge part of the up-down airflow direction plate of the indoor unit of Embodiment 1 of the present invention.
Figure 8:
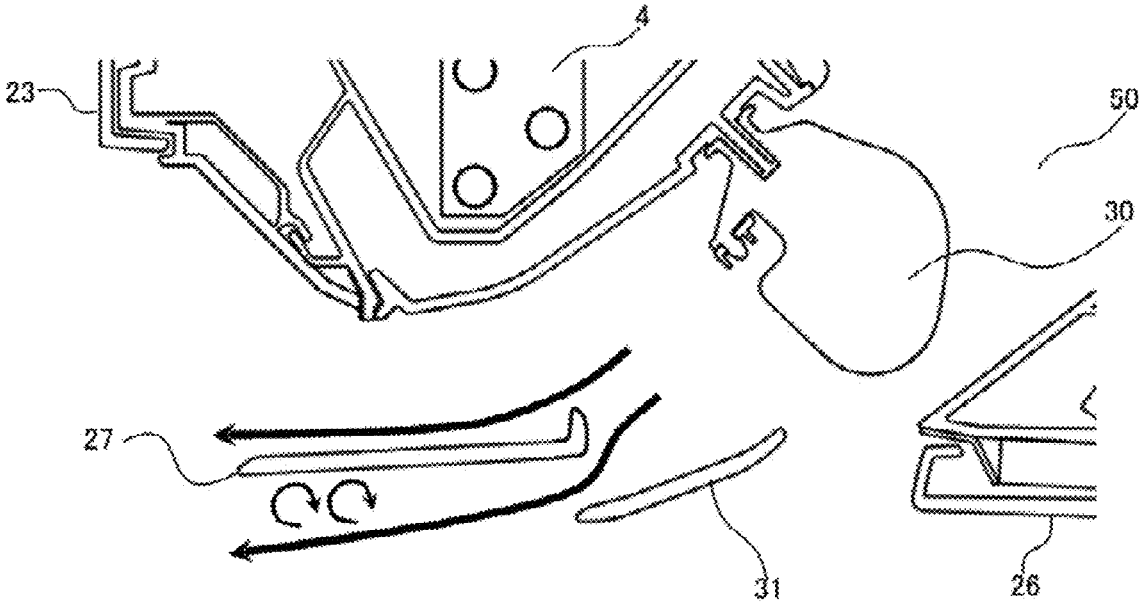
FIG. 8 is a longitudinal section viewed from a side illustrating the vicinity of the air outlet of the indoor unit of Embodiment 1 of the present invention when an angle $\alpha$ of the up-down airflow direction plate is equal to or less than 130 degrees.

FIG. 5 is a schematic longitudinal section viewed from a side illustrating a vicinity of an air outlet of a conventional indoor unit. FIG. 6 is a schematic longitudinal section viewed from a side illustrating a vicinity of the air outlet 22 of the indoor unit 2. FIG. 7 is a graph showing the relationship of a pressure loss ratio to the length of the rear edge part 34 of the up-down airflow direction plate 27 of the indoor unit 2. FIG. 8 is a longitudinal section viewed from a side illustrating the vicinity of the air outlet 22 when the angle α of the up-down airflow direction plate 27 of the indoor unit 2 is equal to or less than 130 degrees. With reference to FIGS. 5 to 8, the air blown off from the air outlet 22 will be explained with comparison to a conventional example. Note that, in FIG. 5, "X" letters are given to the reference sings to distinguish the conventional indoor unit from the indoor unit 2 of the air-conditioning apparatus 1.

As a conventional example, FIG. 5 shows an example in which an up-down airflow direction plate 27X is formed of one flat plate. In addition, an air outlet 22X is provided with a right-left airflow direction plate 30X for controlling the direction of airflow in a right-left direction, the up-down airflow direction plate 27X for controlling the direction of airflow in an up-down direction, and an auxiliary airflow direction plate 31X. The right-left airflow direction plate 30X is arranged on the upstream side of the up-down airflow direction plate 27X and the auxiliary airflow direction plate 31X in the direction of airflow. In this example, a case is assumed where, in a cooling operation, the tilt β of the up-down airflow direction plate 27X to the vertical is set to 105 degrees or less.

In such a case, the flow of the cold air cooled by an indoor heat exchanger 4X separates, at a rear end of the up-down airflow direction plate 27X as a starting point, from the underside surface of the up-down airflow direction plate 27X. As a result, a surrounding air having a higher temperature and a higher humidity than the cold air is brought into contact with the underside surface of the up-down airflow direction plate 27X. Because the cold air stays in contact with the upside surface of the up-down airflow direction plate 27X, dew condensation occurs on the underside surface of the up-down airflow direction plate 27X when the temperature of the up-down airflow direction plate 27X is reduced to the dew point of the surrounding air or below.

Furthermore, because the up-down airflow direction plate 27X is formed as one flat plate, the stiffness of the up-down airflow direction plate 27X is low and a part in the longitudinal direction of the up-down airflow direction plate 27X that is not supported by a rotation shaft 32*a*X may bend under its own weight. By such deformation, the up-down airflow direction plate 27X may have an unintended size or angle. Consequently, not only the formation of dew on the up-down airflow direction plate 27X due to the separation of the flow of the cold air from the up-down airflow direction plate 27X, but also an increase in pressure loss of the air blown off from the air outlet 22X may cause deterioration of the performance. In addition, even when the up-down airflow direction plate 27X is fully closed, such deformation forms a gap between the up-down airflow direction plate 27X and a front panel 23X, and as a result, dirt may enter the air outlet 22X from the gap and the up-down airflow direction plate 27X and the air outlet 22X may be fouled or damaged.

On the other hand, in Embodiment 1, the indoor unit 2 includes the up-down airflow direction plate 27 having the configuration shown in FIG. 4. In this example, a case is assumed where, in a cooling operation, the tilt β of the main blade part 33 of the up-down airflow direction plate 27 to the vertical is set between 90 to 105 degrees.

In this case, the flow of the cold air cooled by the indoor heat exchanger 4 does not separate from the underside surface of the up-down airflow direction plate 27 due to the Coanda effect. As a result, the cold air cooled by the indoor heat exchanger 4 flows along the upside surface and the underside surface of the up-down airflow direction plate 27. Consequently, a surrounding air having a higher temperature and a higher humidity than the cold air is not brought into contact with the up-down airflow direction plate 27 and thus dew condensation does not occur on the up-down airflow direction plate 27.

It is preferable that the length in the lateral direction of the rear edge part 34 of the up-down airflow direction plate 27 be in a range from 5 to 15 mm. When the length of the rear edge part 34 is equal to or less than 5 mm, the flow of the cold air can separate from the underside surface of the up-down airflow direction plate 27 and dew concentration can occur on the underside surface of the up-down airflow direction plate 27. When the length of the rear edge part 34 is equal to or greater than 15 mm, the rear edge part 34 blocks the flow of the air, and as a result, as shown in FIG. 7, pressure loss increases and the performance can be significantly deteriorated.

In addition, it is preferable that the angle α formed between the main blade part 33 and the rear edge part 34 of the up-down airflow direction plate 27 be in a range from 130 to 165 degrees. When the angle α is equal to or less than 130 degrees and the tilt β is in a range from 90 to 105 degrees, the cold air that hits the rear edge part 34 meanders downward and the flow of the cold air separates from the underside surface of the up-down airflow direction plate 27, as shown in FIG. 8. When the angle α is equal to or greater than 165 degrees, the Coanda effect that makes the cold air flow along the underside surface of the up-down airflow direction plate 27 is lost, and as a result, the flow of the cold air separates from the underside surface of the up-down airflow direction plate 27.

<Relationship Between Up-Down Airflow Direction Plate 27 and Auxiliary Airflow Direction Plate 31>

Figure 9:
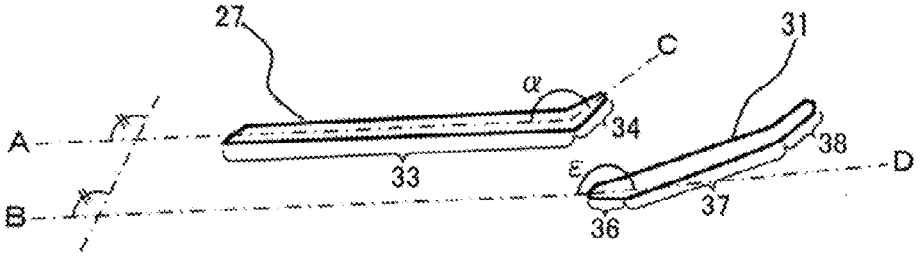
FIG. 9 is a schematic longitudinal section viewed from a side illustrating the up-down airflow direction plate and an auxiliary airflow direction plate provided in the indoor unit of Embodiment 1 of the present invention.

As described above, in the indoor unit 2, the air flowing under the up-down airflow direction plate 27 does not separate from the up-down airflow direction plate 27 even when the up-down airflow direction plate 27 rotates. The relationship, to this end, between the up-down airflow direction plate 27 and the auxiliary airflow direction plate 31 will be explained. FIG. 9 is a schematic longitudinal section viewed from a side illustrating the up-down airflow direction plate 27 and the auxiliary airflow direction plate 31 provided in the indoor unit 2.

First, the auxiliary airflow direction plate 31 will be explained.

As shown in FIG. 9, the auxiliary airflow direction plate 31 is made up of a tip part 36 that is located at the most downstream side of the airflow, a main blade part 37 extended continuously from the tip part 36, and a rear edge part 38 extended continuously from the main blade part 37 and located at the most upstream side of the airflow. The main blade part 37 is arranged between the tip part 36 and the rear edge part 38, that is, at a center portion of the auxiliary airflow direction plate 31, has the largest exposed area, and is formed as a flat plate having a largest length.

Note that, while the auxiliary airflow direction plate 31 including the rear edge part 38 is illustrated as an example in FIG. 9, the auxiliary airflow direction plate 31 needs to have at least the tip part 36 and the main blade part 37, and the rear edge part 38 is not an essential component. In addition, the auxiliary airflow direction plate 31 may be configured such that the tip part 36 is formed as a part of the main blade part 37. Furthermore, a component (e.g., rear edge part 38) other than the tip part 36 and the main blade part 37 may be combined with the auxiliary airflow direction plate 31.

As illustrated in FIG. 5, when the airflow under the underside surface of the up-down airflow direction plate 27X separates from the up-down airflow direction plate 27X, a surrounding air having a higher temperature and a higher humidity than the cold air is brought into contact with the underside surface of the up-down airflow direction plate 27X. The cold air stays in contact with the upside surface of the up-down airflow direction plate 27X, thereby cooling the up-down airflow direction plate 27X. Consequently, the surrounding air that has a higher temperature and a higher humidity than the cold air that is in contact with the underside surface of the up-down airflow direction plate 27X is cooled by the cold air that is in contact with the upside surface of the up-down airflow direction plate 27X. As a result, dew condensation may occur on the underside surface of the up-down airflow direction plate 27X, and may form dew drops that can be blown off forward or downward.

In addition, the indoor unit provided with only one airflow direction plate cannot prevent the airflow from separating from the underside surface of the airflow direction plate, and thus cannot prevent dew concentration from occurring on the underside surface of the airflow direction plate.

Furthermore, the indoor unit in which only the angular relation between the airflow direction plate and the wall surface on the back side of an air passage is specified cannot prevent the airflow from separating from the underside surface of the airflow direction plate that is variably controlled, and thus cannot prevent dew concentration from occurring on the underside surface of the airflow direction plate.

On the other hand, by setting the relationship between the up-down airflow direction plate 27 and the auxiliary airflow direction plate 31 as described below, the indoor unit 2 can prevent the airflow under the underside surface of the up-down airflow direction plate 27 from separating from the up-down airflow direction plate 27.

A reference line A shown in FIG. 9 represents a virtual line that passes through the center of the main blade part 33 of the up-down airflow direction plate 27. A reference line B shown in FIG. 9 represents a virtual line that is obtained by moving in parallel to the reference line A to the tip of the tip part 36 of the auxiliary airflow direction plate 31. A reference line C shown in FIG. 9 represents a virtual line that passes through the center of the rear edge part 34 of the up-down airflow direction plate 27. A reference line D shown in FIG. 9 represents a virtual line that passes through the center of the tip part 36 of the auxiliary airflow direction plate 31. The angle α shown in FIG. 9 represents the angle between the main blade part 33 and the rear edge part 34, that is, the angle formed between the reference line A and the reference line C. The angle ε shown in FIG. 9 represents the angle between the main blade part 33 and the tip part 36 of the auxiliary airflow direction plate 31, that is, the angle formed between the reference line B (reference line A) and the reference line D.

As described above, the auxiliary airflow direction plate 31 is arranged closer to the back face than is the up-down airflow direction plate 27, that is, on the upstream side of the up-down airflow direction plate 27 in the direction of airflow. In addition, in the indoor unit 2, by rotating the up-down airflow direction plate 27 and the auxiliary airflow direction plate 31, the indoor unit 2 can direct the airflow to a direction that a user wants.

As shown in FIG. 9, the auxiliary airflow direction plate 31 is arranged below the up-down airflow direction plate 27 during operation. With this configuration, the auxiliary airflow direction plate 31 becomes capable of acting on the airflow under the up-down airflow direction plate 27. That is, during operation, the up-down airflow direction plate 27 and the auxiliary airflow direction plate 31 rotate in a state where the virtual line (reference line D) passing through the center of the tip part 36 of the auxiliary airflow direction plate 31 remains in parallel to the virtual line (reference line A) passing through the center of the main blade part 33 of the up-down airflow direction plate 27. Consequently, the parallel relation between the reference line A and the reference line D is maintained even when the up-down airflow direction plate 27 and the auxiliary airflow direction plate 31 rotate. Note that it is not required that the reference line A and the reference D are exactly in parallel, and a range of −5 degrees to +5 degrees is determined as parallel.

Furthermore, the angle ε is configured to be greater than the angle α and the relation of the angle ε>the angle α is maintained even when the up-down airflow direction plate 27 and the auxiliary airflow direction plate 31 rotate. With this configuration, the auxiliary airflow direction plate 31 can act on the airflow under the up-down airflow direction plate 27 to prevent the airflow from separating from the up-down airflow direction plate 27.

As described above, because the indoor unit 2 includes the up-down airflow direction plate 27 and the auxiliary airflow direction plate 31 such that the abovementioned relations are satisfied, the airflow can be directed to a desired direction of the user, and the airflow under the up-down airflow direction plate 27 can be prevented from separating from the up-down airflow direction plate 27, and as a result, dew concentration does not occur on the up-down airflow direction plate 27.

Figure 10:
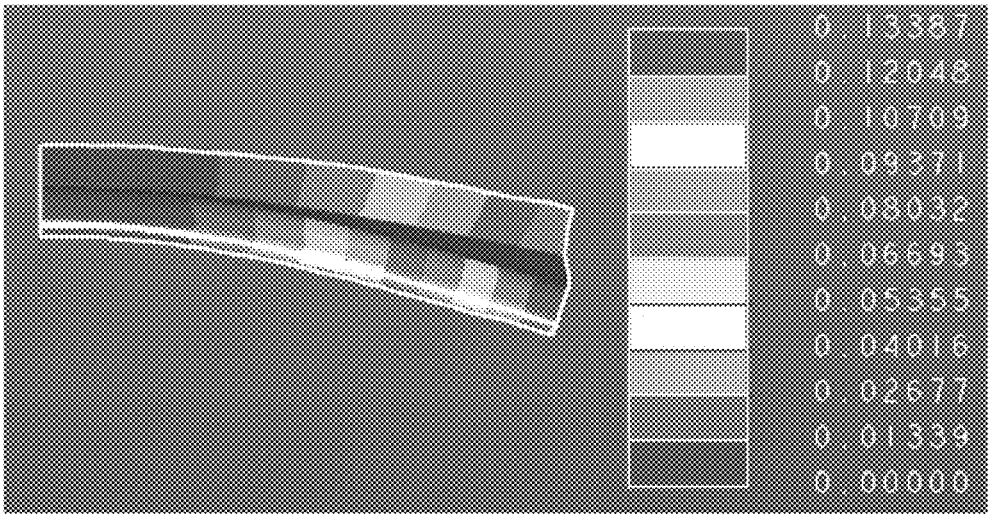
FIG. 10 includes a simulation diagram illustrating an analysis result of displacement amounts of the up-down airflow direction plate of the indoor unit of Embodiment 1 of the present invention.
Figure 10:
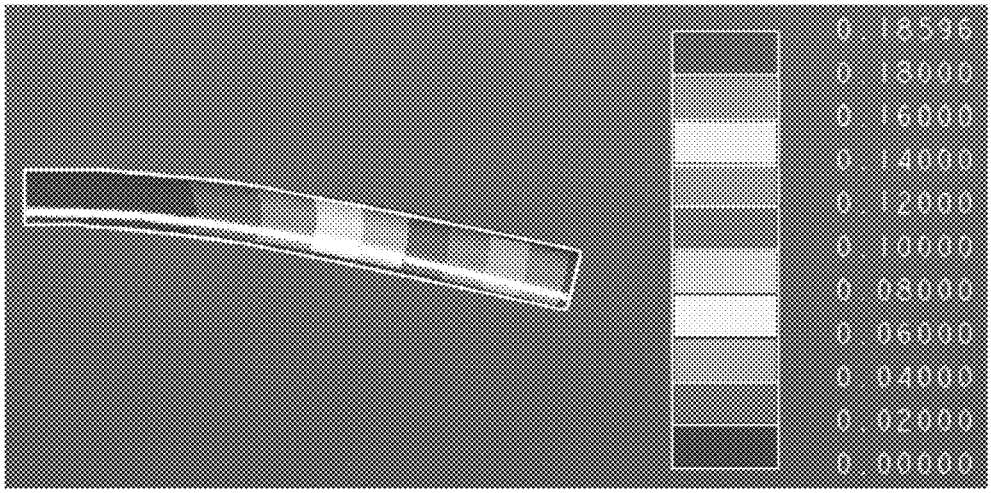

FIG. 10 includes a simulation diagram illustrating an analysis result of displacement amounts of the up-down airflow direction plate 27 when an edge surface stress of 5 N is applied to a position 30 mm away from an end in the longitudinal direction in the up-down airflow direction plate 27 that has the rear edge part 34 having a length of 5 mm and has the angle α of 150 degrees. The lower diagram in FIG. 10 shows, as a comparison example, an analysis result of displacement amounts of the up-down airflow direction plate 27X illustrated in FIG. 5.

As shown in FIG. 10, the displacement amounts of the up-down airflow direction plate 27 provided with the rear edge part 34 are reduced to about 72% compared with the displacement amounts of the conventional up-down airflow direction plate 27X formed of one flat plate. That is, the stiffness in the longitudinal direction of the up-down airflow direction plate 27 improves 1.4 times by adopting the rear edge part 34, compared with the up-down airflow direction plate 27X, thereby preventing bend of the up-down airflow direction plate 27 in the longitudinal direction. Consequently, because the up-down airflow direction plate 27 can be set to specified size and angle, dew concentration on the up-down airflow direction plate 27 is prevented, and as a result, the pressure loss of the air is kept small and deterioration of the performance is not caused. In addition, when the up-down airflow direction plate 27 is fully closed, no gap is formed between the up-down airflow direction plate 27 and the front panel 23, and as a result, dirt does not enter the inside of the air outlet 22, and the up-down airflow direction plate 27 and the inside of the air outlet 22 are not be fouled or damaged.

Note that, to improve the stiffness in the longitudinal direction of the up-down airflow direction plate 27, the entire up-down airflow direction plate 27 can be curved in the lateral direction. However, when the entire up-down airflow direction plate 27 is curved, the cold air flowing above the up-down airflow direction plate 27 can move upward, thereby cooling the front panel 23. When the front panel 23 is cooled, dew concentration may occur on the front panel 23. For this reason, a configuration in which the entire up-down airflow direction plate 27 is curved in the lateral direction is not adopted.

As described above, in the indoor unit 2, because the indoor unit 2 includes the up-down airflow direction plate 27 in which the rear edge part 34 is joined to the upstream side of the main blade part 33 with the angle α at which the rear edge part 34 is inclined upward to the back face of the casing 20 from the main blade part 33, the cold air flows along the up-down airflow direction plate 27 without separating from the underside surface of the up-down airflow direction plate 27 in a cooling operation, and as a result, a surrounding air having a higher temperature and a higher humidity than the cold air is not brought into contact with the up-down airflow direction plate 27 and dew concentration on the up-down airflow direction plate 27 can prevented.

Furthermore, in the indoor unit 2, the up-down airflow direction plate 27 is formed of the main blade part 33 and the rear edge part 34, the stiffness of the up-down airflow direction plate 27 is increased, thereby reducing deformation of the up-down airflow direction plate 27. That is, because the rear edge part 34 acts as a reinforcer, the stiffness of the up-down airflow direction plate 27 is improved, compared to an up-down airflow direction plate formed of one flat plate, and as a result, deformation of the up-down airflow direction plate 27 does not occur. Consequently, because the shape of the up-down airflow direction plate 27 is maintained with specified size and angle, dew concentration on the up-down airflow direction plate 27 does not occur and the pressure loss of the air is kept small. Consequently, deterioration of the performance is not caused.

In addition, in the indoor unit 2, when the up-down airflow direction plate 27 is fully closed, no gap is formed between the up-down airflow direction plate 27 and the front panel 23, and as a result, dirt does not enter the inside of the air outlet 22, and the up-down airflow direction plate 27 and the inside of the air outlet 22 are not be fouled or damaged.

Embodiment 2

Figure 11:
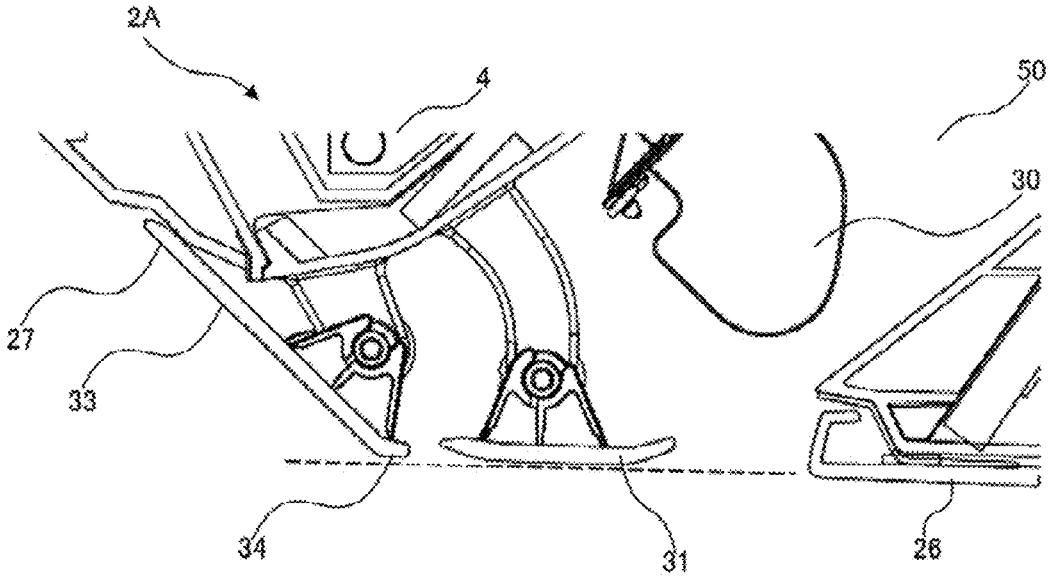
FIG. 11 is a schematic longitudinal section viewed from a side illustrating a vicinity of an air outlet of an indoor unit of Embodiment 2 of the present invention.

FIG. 11 is a schematic longitudinal section viewed from a side illustrating a vicinity of an air outlet 22 of an indoor unit 2A in an air-conditioning apparatus 1 of Embodiment 2 of the present invention. With reference to FIG. 11, the indoor unit 2A will be explained. Note that, in Embodiment 2, features different from those of Embodiment 1 will be mainly explained, and the same reference signs are used for the same parts as Embodiment 1, and the explanations of the same parts are omitted.

As shown in FIG. 11, the angle α may be determined so that, when the air outlet 22 is fully closed by an up-down airflow direction plate 27, a rear edge part 34 is positioned flush with a bottom panel 26.

In such a case where the angle α is determined in this manner, the rear edge part 34 is positioned flush with the bottom panel 26 when the air outlet 22 is fully closed. Consequently, when the air outlet 22 is fully closed, because only a main blade part 33 that is flat can be seen at the air outlet 22 when the indoor unit 2 is viewed from the front, the air outlet 22 looks as if the air outlet 22 is formed with only flat surface, and as a result, the appearance of the indoor unit 2A is improved.

As described above, in the indoor unit 2A, in a case where the air outlet 22 is fully closed, because only the main blade part 33 can be seen at the air outlet 22 when the indoor unit 2A is viewed from the front, the air outlet 22 looks as if the air outlet 22 is formed with only flat surface, and as a result, the appearance of the indoor unit 2A is improved.

REFERENCE SIGNS LIST

1 air-conditioning apparatus 2 indoor unit 2A indoor unit 3 outdoor unit 4 indoor heat exchanger 4X indoor heat exchanger 5 indoor fan 6 outdoor heat exchanger 7 outdoor fan 8 compressor 9 four-way switching valve 10 expansion valve 11 gas-side communication pipe 12 liquid-side communication pipe 13 refrigerant circuit 20 casing 21 air inlet 22 air outlet 22X air outlet 23 front panel 23X front panel 24 side panel 25 back panel 26 bottom panel 27 up-down airflow direction plate 27X up-down airflow direction plate 28 top panel 30 right-left airflow direction plate 30X right-left airflow direction plate 31 auxiliary airflow direction plate 31X auxiliary airflow direction plate 32 supporter 32*a* rotation shaft 32*a*X rotation shaft main blade part 34 rear edge part 35 auxiliary supporter 35*a* auxiliary rotation shaft 36 tip part 37 main blade part 38 rear edge part 50 air passage K wall surface R room T ceiling

The invention claimed is:

1. An indoor unit for an air-conditioning apparatus, comprising:

a casing having an air inlet and an air outlet;

an up-down airflow direction plate configured to be rotatably supported in the air outlet; and an auxiliary airflow direction plate configured to be rotatably supported at a position below the up-down airflow direction plate and on an upstream side of the up-down airflow direction plate, the up-down airflow direction plate having a main blade part formed of a flat plate, and a rear edge part formed of a flat plate and formed on an upstream side of the main blade part, when the main blade part is in a horizontal state, the rear edge part being inclined upward to a back face of the casing from the main blade part, when an angle α represents an angle formed between the main blade part and the rear edge part and an angle ε represents an angle formed between the main blade part and a virtual line passing through a center of a tip part of the auxiliary airflow direction plate, the angle ε being greater than the angle α.

2. The indoor unit for an air-conditioning apparatus of claim 1, wherein, while the indoor unit is operating, the up-down airflow direction plate and the auxiliary airflow direction plate rotate in a state where the virtual line passing through the center of the tip part of the auxiliary airflow direction plate remains in parallel to a virtual line passing through a center of the main blade part of the up-down airflow direction plate.

3. The indoor unit for an air-conditioning apparatus of claim 1, wherein the angle α is in a range from 130 to 165 degrees.

4. The indoor unit for an air-conditioning apparatus of claim 1, wherein a length in a lateral direction of the rear edge part is in a range from 5 to 15 mm.

5. The indoor unit for an air-conditioning apparatus of claim 1, wherein the angle α is set such that, when the air outlet is fully closed by the up-down airflow direction plate, the rear edge part is positioned flush with a bottom panel of the casing.

* * * * *